United States Patent [19]

Kametani et al.

[11] Patent Number: 5,032,176

[45] Date of Patent: Jul. 16, 1991

[54] METHOD FOR MANUFACTURING TITANIUM POWDER OR TITANIUM COMPOSITE POWDER

[75] Inventors: Hiroshi Kametani, Yokohama; Hidenori Sakai, Hoya, both of Japan

[73] Assignees: N.K.R. Company, Ltd.; Kokan Mining Co., Ltd., both of Tokyo, Japan

[21] Appl. No.: 516,447

[22] Filed: Apr. 30, 1990

[30] Foreign Application Priority Data

May 24, 1989 [JP] Japan ..... 1-130919

[51] Int. Cl.[5] ..... C22B 34/00

[52] U.S. Cl. ..... 75/416

[58] Field of Search ..... 75/343, 611-614

[56] References Cited

U.S. PATENT DOCUMENTS 2,828,199 3/1958 Findlay ..... 75/611

2,975,049 3/1961 Jazwinski ..... 75/343

*Primary Examiner*—Peter D. Rosenberg

*Attorney, Agent, or Firm*—Frishauf, Holtz, Goodman & Woodward

[57] ABSTRACT

A method for manufacturing a titanium powder, which comprises the steps of: causing a molten reducing agent comprising molten magnesium at a temperature of 650° to 900° C. or molten sodium at a temperature of 100° to 900° C. to fall into a reaction vessel; ejecting a titanium tetrachloride gas at a temperature of 650° to 900° C. toward the falling flow of the molten reducing agent in the reaction vessel to atomize the molten reducing agent, and producing titanium particles containing molten reaction product which comprises molten magnesium chloride or molten sodium chloride, through a reducing reaction between the atomized molten reducing agent and the titanium tetrachloride gas; and removing the reaction product from the titanium particles containing the reaction product to manufacture a titanium powder.

23 Claims, 1 Drawing Sheet

METHOD FOR MANUFACTURING TITANIUM POWDER OR TITANIUM COMPOSITE POWDER

FIELD OF THE INVENTION

The present invention relates to a method for manufacturing a titanium powder or a titanium composite powder.

BACKGROUND OF THE INVENTION

Titanium or a titanium alloy is widely applied as a material for various parts of aircraft and machines and equipment for the chemical industry because of a high melting point (titanium has a melting point of 1,668° C.), a high strength, a high toughness, a low density and an excellent corrosion resistance.

However, because of the high melting point of titanium or a titanium alloy as described above, it is not easy to manufacture various parts from titanium or a titanium alloy through a precision casting, which requires a high manufacturing cost.

A known method for manufacturing a titanium part at a lower cost is a powder metallurgy process which comprises: preparing a titanium powder, then forming the thus prepared titanium powder into a green compact of a prescribed shape through a press forming, and then sintering the thus formed green compact. Another known method for manufacturing a titanium alloy part at a lower cost is another powder metallurgy process which comprises: preparing a mixed powder by mixing a titanium powder with another metal powder which is to be alloyed with the titanium powder, then forming the thus prepared mixed powder into a green compact of a prescribed shape through a press forming, and then sintering the thus formed green compact.

When manufacturing various parts from titanium or a titanium alloy in accordance with one of the above-mentioned powder metallurgy processes, it is necessary to use a titanium powder or a titanium composite powder as a material.

As methods for manufacturing a titanium powder as the above-mentioned material, the following methods are known.

(A) First, a sponge titanium is prepared by means of any one of the following processes:

(i) A lumpy magnesium is charged into a steel vessel keeping an argon gas atmosphere, and heated to prepare a molten magnesium. Then, a liquid titanium tetrachloride at a room temperature is caused to fall dropwise from above into the vessel. The dropping titanium tetrachloride becomes a titanium tetrachloride gas because of the boiling point thereof of 136° C. A sponge titanium (Ti) and magnesium chloride ($MgCl_2$) are produced through a reducing reaction as expressed in the following formula (1) between the titanium tetrachloride gas and the molten magnesium:

$$TiCl_4+2Mg \rightarrow Ti+2MgCl_2 \quad (1).$$

Then, the thus produced sponge titanium is separated from the magnesium chloride. The above-mentioned process for obtaining the sponge titanium is widely known as the "Kroll process".

(ii) A lumpy sodium is charged into a steel vessel keeping an argon gas atmosphere, and heated to prepare a molten sodium. Then, a liquid titanium tetrachloride at a room temperature is caused to fall dropwise from above into the vessel. The dropping titanium tetrachloride becomes a titanium tetrachloride gas because of the boiling point thereof of 136° C. A sponge titanium (Ti) and sodium chloride (NaCl) are produced through a reducing reaction as expressed in the following formula (2) between the titanium tetrachloride gas and the molten sodium:

$$TiCl_4+4Na \rightarrow Ti+4NaCl \quad (2).$$

Then, the thus produced sponge titanium is separated from the sodium chloride. The above-mentioned process for obtaining the sponge titanium is widely known as the "Hunter process".

(B) Then, a titanium powder is manufactured by means of any one of the following processes with the use of the sponge titanium prepared as described above:

(a) The sponge titanium is pulverized by means of a grinding machine to manufacture a titanium powder (hereinafter referred to as the "prior art 1").

(b) The sponge titanium is first caused to absorb hydrogen to make the sponge titanium brittle. Then, the brittle sponge titanium is pulverized by means of a grinding machine to prepare titanium particles. The titanium particles are then dehydrogenated to manufacture a titanium powder (hereinafter referred to as the "prior art 2").

(c) The titanium powder obtained by the prior art 1 is formed into a green compact having an electrode-shape through a press forming. Then, the thus formed green compact is charged with electricity to melt same. The resultant melt is then cast into a high-purity titanium ingot. Then, the thus obtained titanium ingot is melted by means of an electric arc. The molten titanium is then caused to fall into a vessel keeping an inert gas atmosphere, and a compressed inert gas is ejected toward the falling flow of the molten titanium, or a centrifugal force is caused to act on the falling flow of the molten titanium, to atomize the molten titanium. The thus atomized molten titanium is rapidly cooled and solidified, thereby to manufacture a titanium powder (hereinafter referred to as the "prior art 3").

However, the above-mentioned prior arts 1 to 3 have the following problems:

(1) In the above-mentioned preparing processes (i) and (ii) of the sponge titanium, when a reducing reaction temperature in the steel vessel reaches at least 1,000° C., iron forming the vessel reacts with produced titanium to produce Fe-Ti (Fe-Ti has a eutectic temperature of 1,080° C.), resulting in a lower manufacturing yield of the sponge titanium. In order to avoid the production of the above-mentioned Fe-Ti, it is necessary to keep the reducing reaction temperature in the steel vessel to up to 960° C. For this purpose, it is necessary to use a larger steel vessel, or to control the quantity of titanium tetrachloride supplied to the steel vessel. This control is not however easy. Even if a larger steel vessel is employed, there would not be much improvement in the productivity.

(2) In the prior arts 1 to 3, a sponge titanium is first prepared through reduction of titanium tetrachloride in accordance with the Kroll process or the Hunder process, and then the thus prepared sponge titanium is pulverized or atomized, thus requiring two steps, and hence requiring many facilities and much time. In addition, since the above-mentioned sponge titanium is prepared in a batch manner, the production efficiency is very low. Furthermore, each of the particles of the titanium powder manufactured through pulverization of the sponge titanium, having an irregular shape including a projection or an acute edge, is low in pressformability.

(3) In the prior art 3, it is necessary, as described above, to melt a high-purity titanium ingot, and then atomize the molten titanium, in order to manufacture a high-purity titanium powder. However, large-scale facilities are required for melting the titanium ingot and atomizing same.

(4) When manufacturing parts of a titanium alloy, uniform mixing of the titanium powder with another metal powder which is to be alloyed with the titanium powder, requires a high-level technology. It is therefore difficult to manufacture parts comprising a uniform titanium alloy.

Under such circumstances, there is a strong demand for the development of a method which permits continuous manufacture, in simple steps and at a high productivity, of a titanium powder or a titanium composite powder as a material for the manufacture of titanium articles or titanium alloy articles by a powder metallurgy process, but such a method has not as yet been proposed.

SUMMARY OF THE INVENTION

An object of the present invention is therefore to provide a method which permits continuous manufacture, in simple steps and at a high productivity, of a titanium powder or a titanium composite powder as a material for the manufacture of titanium articles or titanium alloy articles by a powder metallurgy process.

In accordance with one of the features of the present invention, there is provided a method for manufacturing a titanium powder, characterized by comprising the steps of:

causing a molten reducing agent at a temperature within the range of from 100° to 900° C. to continously fall into a reaction vessel;

ejecting a titanium tetrachloride gas at a temperature within the range of from 650° to 900° C. toward the falling flow of said molten reducing agent in said reaction vessel to atomize said molten reducing agent, and producing a molten reaction product and titanium particles contining said molten reaction product through a reducing reaction between said atomized molten reducing agent and said titanium tetrachloride gas;

separating said titanium particles containing said reaction product from said molten reaction product outside said reaction vessel; and removing said reaction product from said titanium particles containing said reaction product to obtain a titanium powder.

In accordance with another one of the features of the present invention, there is provided a method for manufacturing a titanium composite powder, characterized by comprising the steps of:

causing a molten reducing agent comprising a molten alloy at a temperature within the range of from 100° to 900° C. to continuously fall into a reaction vessel;

ejecting a titanium tetrachloride gas at a temperature within the range of from 650° to 900° C. toward the falling flow of said molten reducing agent in said reaction vessel to atomize said molten reducing agent, and producing a molten reaction product and titanium composite particles containing said molten reaction product through a reducing reaction between said atomized molten reducing agent and said titanium tetrachloride gas;

separating said titanium composite particles containing said reaction product from said molten reaction product outside said reaction vessel; and removing said reaction product from said titanium composite particles containing said reaction product to manufacture a titanium composite powder.

In accordance with further another one of the features of the present invention, there is provided another method for manufacturing a titanium composite powder, characterized by comprising the steps of:

causing a molten reducing agent at a temperature within the range of from 100° to 900° C. to continuously fall into a reaction vessel;

ejecting a mixed gas at a temperature within the range of from 650° to 900° C., which comprises a titanium tetrachloride gas and a chloride gas of at least one metal selected from the group consisting of aluminum, vanadium, tin, chromium, iron, zirconium and zinc, toward the falling flow of said molten reducing agent in said reaction vessel to atomize said molten reducing agent, and producing a molten reaction product and titanium composite particles containing said molten reaction product through a reducing reaction between said atomized molten reducing agent and said mixed gas;

separating said titanium composite particles containing said reaction product from said molten reaction product outside said reaction vessel; and removing said reaction product from said titanium composite particles containing said reaction produce to manufacture a titanium composite powder.

DETAILED DESCRIPTION OF PREFERRED EMBODIMENTS

Figure 1:
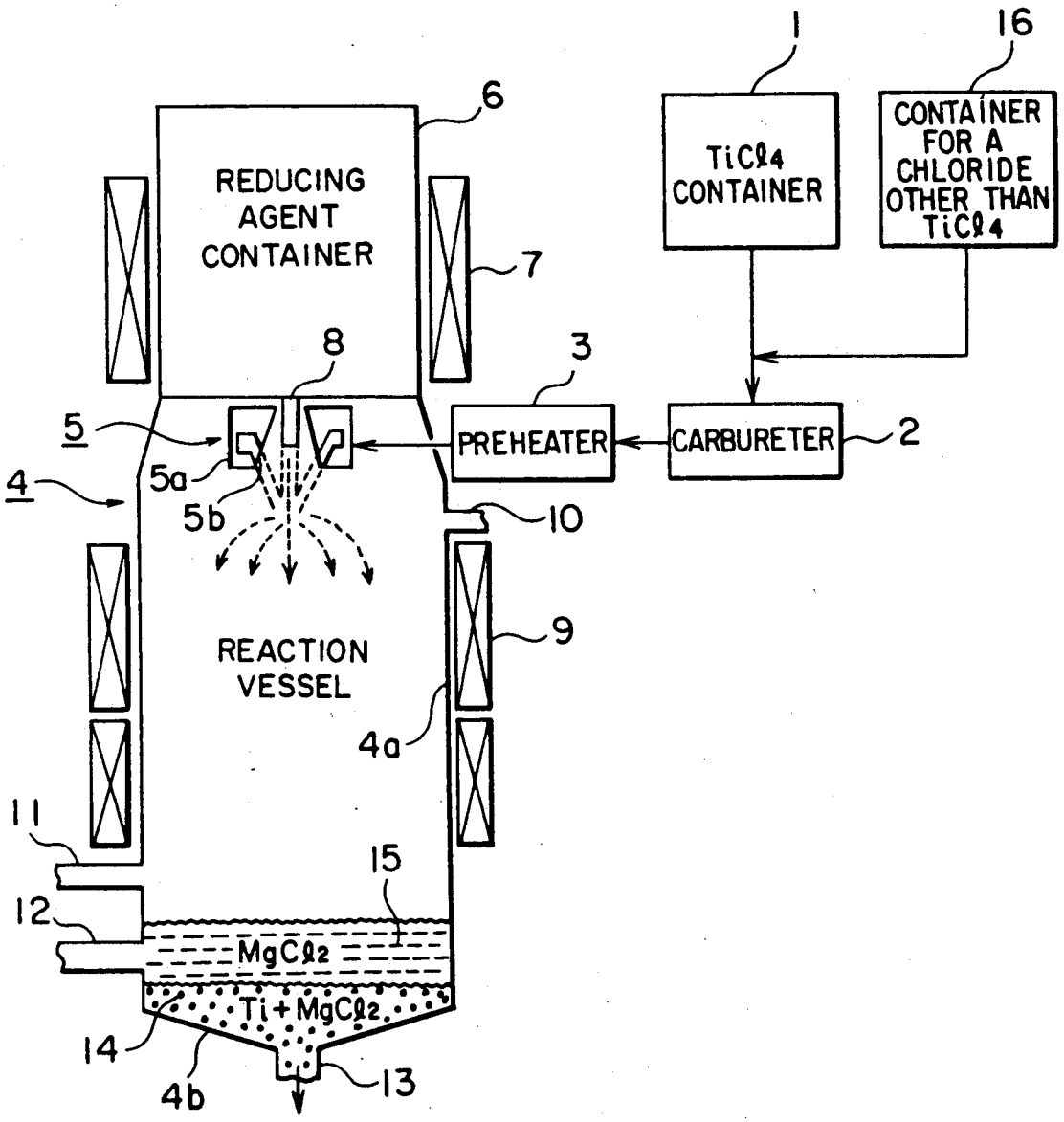
FIG. 1 is a schematic flow diagram illustrating the method of the present invention.

From the above-mentioned point of view, extensive studies were carried out to develop a method which permits continuous manufacture, in simple steps and at a high productivity, of a titanium powder or a titanium composite powder as a material for the manufacture of titanium parts or titanium alloy parts by a powder metallurgy process. As a result, the following finding was obtained:

Titanium tetrachloride has a low boiling point and is characterized by an easy reducing reaction with a reducing agent. By using a titanium tetrachloride gas and a molten reducing agent such as molten magnesium or molten sodium, it is therefore possible to easily cause a reducing reaction. Therefore, when causing molten magnesium or molten sodium to fall into a reaction vessel, and ejecting a titanium tetrachloride gas toward the falling flow of molten magnesium or molten sodium, molten magnesium or molten sodium is atomized by the titanium tetrachloride gas. A reducing reaction expressed in the above-mentioned formula (1) or (2) takes place between the atomized molten magnesium or the atomized molten sodium and the titanium tetrachloride gas, thereby to produce titanium particles.

For example, in the reducing reaction expressed in formula (1):

$$TiCl_4 + 2Mg \rightarrow Ti + 2MgCl_2 \quad (1)$$

$TiCl_4$ of 1 mol (189.9 g) reacts with Mg of 2 mol (48.6 g) to produce Ti of 1 mol (47.9 g) and $MgCl_2$ of 2 mol (190.6 g).

A first embodiment of the method of the present invention was made on the basis of the above-mentioned finding, and the method of the first embodiment of the present invention for manufacturing a titanium powder comprises the steps of:

causing a molten reducing agent at a temperature within the range of from 100° to 900° C. to continuously fall into a reaction vessel;

ejecting a titanium tetrachloride gas at a temperature within the range of from 650° to 900° C. toward the falling flow of said molten reducing agent in said reaction vessel to atomize said molten reducing agent, and producing a molten reaction product and titanium particles containing said molten reaction product through a reducing reaction between said atomized molten reducing agent and said titanium tetrachloride gas;

separating said titanium particles containing said reaction product from said molten reaction product outside said reaction vessel; and removing said reaction product from said titanium particles containing said reaction product to manufacture a titanium powder.

The following another finding was obtained: By using a molten magnesium alloy or a molten sodium alloy in place of the above-mentioned molten magnesium or molten sodium, a reducing reaction expressed in the above-mentioned formula (1) or (2) takes place between the atomized molten magnesium alloy or the atomized molten sodium alloy and the titanium tetrachloride gas, thereby to produce titanium composite particles.

A second embodiment of the method of the present invention was made on the basis of the above-mentioned another finding, and the method of the second embodiment of the present invention for manufacturing a titanium composite powder comprises the steps of:

causing a molten reducing agent comprising a molten alloy at a temperature within the range of from 100° to 900° C. to continuously fall into a reaction vessel;

ejecting a titanium tetrachloride gas at a temperature within the range of from 650° to 900° C. toward the falling flow of said molten reducing agent in said reaction vessel to atomize said molten reducing agent, and producing a molten reaction product and titanium composite particles containing said-molten reaction product through a reducing reaction between said atomized molten reducing agent and said titanium tetrachloride gas;

separating said titanium composite particles containing said reaction product from said molten reaction product outside said reaction vessel; and removing said reaction product from said titanium composite particles containing said reaction product to manufacture a titanium composite powder.

The following further another finding was obtained: By using, in place of the above-mentioned titanium tetrachloride gas, a mixed gas comprising a titanium tetrachloride gas and a chloride gas of at least one metal selected from the group consisting of aluminum, vanadium, tin, chromium, iron, zirconium and zinc, a reducing reaction expressed in the above-mentioned formula (1) or (2) takes place between the atomized molten magnesium or the atomized molten sodium and the titanium tetrachloride gas in the mixed gas, thereby to produce titanium composite particles.

A third embodiment of the method of the present invention was made on the basis of the above-mentioned further another finding, and the method of the third embodiment of the present invention for manufacturing a titanium composite powder comprises the steps of:

causing a molten reducing agent at a temperature within the range of from 100° to 900° C. to continuously fall into a reaction vessel;

ejecting a mixed gas at a temperature within the range of from 650° to 900° C., which comprises a titanium tetrachloride gas and a chloride gas of at least one metal selected from the group consisting of aluminum, vanadium, tin, chromium, iron, zirconium and zinc, toward the falling flow of said molten reducing agent in said reaction vessel to atomize said molten reducing agent, and producing a molten reaction product and titanium composite particles containing said molten reaction product through a reducing reaction between said atomized molten reducing agent and said mixed gas;

separating said titanium composite particles containing said reaction product from said molten reaction product outside said reaction vessel; and removing said reaction product from said titanium composite particles containing said reaction product to manufacture a titanium composite powder.

Now, the methods of the first to third embodiments of the present invention are described with reference to the drawing.

FIG. 1 is a schematic flow diagram illustrating the method of the present invention.

The first embodiment of the method of the present invention is described with reference to FIG. 1. As shown in FIG. 1, a liquid titanium tetrachloride at a room temperature is received in a $TiCl_4$ container 1. The liquid titanium tetrachloride is introduced from the $TiCl_4$ container 1 into a carbureter 2, in which the liquid titanium tetrachloride is heated to a temperature within the range of from 150° to 300° C. to become a titanium tetrachloride gas. The thus obtained titanium tetrachloride gas is introduced into a preheater 3, in which the titanium tetrachloride gas is heated to a temperature within the range of from 650° to 900° C., and the thus heated titanium tetrachloride gas is blown into a gas nozzle 5 provided in a reaction vessel 4, as described later.

Above the reaction vessel 4, a reducing agent container 6 for receiving a reducing agent such as magnesium for example, is provided in contact with the upper end of the reaction vessel 4. A lumpy magnesium received in the reducing agent container 6 is heated to a temperature within the range of from 650° to 900° C. to become a molten magnesium by means of a heating means 7 provided on the outer periphery of the reducing agent container 6. The thus obtained molten magnesium falls through a nozzle 8 provided in the bottom wall of the reducing agent container 6 into the reaction vessel 4.

The reaction vessel 4 comprises a gas nozzle 5 provided in the upper portion of the reaction vessel 4, a heating means 9, provided on the outer periphery of the reaction vessel 4, for heating the reaction vessel 4, an inert gas blowing port 10 provided in the upper portion of a side wall 4*a* of the reaction vessel 4, an inert gas discharge port 11 and a molten reaction product discharge port 12, both provided in the lower portion of the side wall 4*a* of the reaction vessel 4, and a titanium particles discharge port 13 provided in a bottom wall 4b of the reaction vessel 4.

The gas nozzle 5 is, for example, an annular band type nozzle which comprises an annular conduit 5a provided so as to surround the nozzle 8 provided in the bottom wall of the reducing agent container 6, and an annular opening 5b provided on the side facing the nozzle 8 so as to be directed toward the falling flow of the molten magnesium falling from the nozzle 8. The titanium tetrachloride gas ejected from the annular opening 5b of the gas nozzle 5 impinges on the falling flow of the molten magnesium falling from the nozzle 8. The gas nozzle 5 may be a plurality of lance type nozzles provided so as to surround the nozzle 8, openings of which are directed toward the falling flow of the molten magnesium falling from the nozzle 8. In general, the annular band type nozzle is used in a large-scaled equipment, whereas the lance type nozzles are employed in a small-sized equipment.

The molten reaction product discharge port 12 is provided in the lower portion of the side wall 4a of the reaction vessel 4, where molten magnesium chloride as a molten reaction product 15 produced in the reaction vessel 4 accumulates. The inert gas discharge port 11 is provided above the molten reaction product discharge port 12 in the lower portion of the side wall 4a of the reaction vessel 4, where molten magnesium chloride as the molten reaction product 15 accumulates.

The molten magnesium is atomized in the reaction vessel 4 by means of the titanium tetrachloride gas ejected through the gas nozzle 5 toward the falling flow of the molten magnesium falling through the nozzle 8 from the reducing agent container 6 into the reaction vessel 4. A reducing reaction expressed in the above-mentioned formula (1):

$$TiCl_4 + 2Mg \rightarrow Ti + 2MgCl_2 \quad (1)$$

takes place between the thus atomized molten magnesium and the titanium tetrachloride gas, thereby to produce molten magnesium chloride ($MgCl_2$) as the molten reaction product 15 and titanium (Ti) particles 14 containing the molten magnesium chloride.

The molten magnesium chloride 15 and the titanium particles 14 containing the molten magnesium chloride having thus produced accumulate on the bottom of the reaction vessel 4, and the titanium particles 14 containing the molten magnesium chloride accumulate under the molten magnesium chloride under the effect of the difference in specific gravity between them. From the molten magnesium chloride 15 and the titanium particles 14 containing the molten magnesium chloride having thus accumulated on the bottom of the reaction vessel 4, the molten magnesium chloride 15 is separated and discharged outside the reaction vessel 4 through the molten reaction product discharge port 12 provided in the lower portion of the side wall 4a of the reaction vessel 4, and then, the titanium particles 14 containing the molten magnesium chloride are discharged outside the reaction vessel 4 through the titanium particles discharge port 13 provided in the bottom wall 4b of the reaction vessel 4. The thus discharged titanium particles 14 containing the magnesium chloride are treated by a known method such as a water leaching or a vacuum evaporation to remove the magnesium chloride from the titanium particles 14, whereby a titanium powder is manufactured.

When a value of Weber number (Wb) as expressed in the following formula (3) is kept within the range between $10^3$ and $10^4$, the molten magnesium falling through the nozzle 8 into the reaction vessel 4 is satisfactorily atomized by means of the titanium tetrachloride gas ejected through the gas nozzle 5 toward the falling flow of the molten magnesium:

$$Wb = \frac{D_L \cdot u^2 \cdot \rho}{\tau} \quad (3)$$

where, $D_L$: inside diameter of the nozzle 8 (cm), u: flow velocity of the titanium tetrachloride gas (cm/sec), $\rho$:difference in density between the molten magnesium and the titanium tetrachloride gas (g/cm$^3$), and $\gamma$: surface tension between the molten magnesium and the titanium tetrachloride gas (dyne/cm).

More specifically, in order to satisfactorily atomize the molten magnesium by means of the titanium tetrachloride gas, namely, in order to keep the value of Weber number (Wb) as expressed in the above-mentioned formula (3) within the range between $10^3$ and $10^4$, values of $D_L$, u, $\rho$ and $\gamma$ in the formula (3) are determined as follows:

(1) first, determining a ratio of the flow rate of the molten magnesium to the flow rate of the titanium tetrachloride gas;

(2) then, setting a value of Weber number (Wb), which makes available the above-mentioned satisfactory atomizing of the molten magnesium;

(3) then, determining the inside diameter ($D_L$) of the nozzle 8 through which the molten magnesium falls into the reaction vessel 4;

(4) then, determining the cross-sectional area of the annular opening 5b of the gas nozzle 5 for ejecting the titanium tetrachloride gas;

(5) then, determining the flow velocity (u) of the titanium tetrachloride gas;

(6) then, determining difference in density ($\rho$) between a density of the molten magnesium at a temperature of the melting point (651° C.) of magnesium and a density of the titanium tetrachloride gas at a temperature of the melting point (651° C.) of magnesium; and (7) using the value of the surface tension of 569 dyne/cm of the molten magnesium at a temperature of the melting point (651° C.) of magnesium as the $\gamma$-value, since the surface tension value of the molten magnesium during the reducing reaction is unknown.

The above-mentioned steps (1) to (7) can be easily determined by means of known chemical industrial techniques.

In order to keep a proper pressure in the reaction vessel 4, it is desirable to blow an inert gas such as argon gas in a slight amount into the reaction vessel 4 through the inert gas blowing port 10 provided in the upper portion of the side wall 4a of the reaction vessel 4.

In the above-mentioned formula (1):

$$TiCl_4 + 2Mg \rightarrow Ti + 2MgCl_2 \quad (1)$$

the quantity of the titanium tetrachloride gas and the quantity of the molten magnesium necessary for the reducing reaction are 1 mol and 2 mol, respectively. The quantity of 1 mol of the titanium tetrachloride gas is about 22.4 l in the normal state, and about 69 l at a temperature of 650° C., about 3.1 times as large as that in the normal state.

However, the molar ratio between the titanium tetrachloride gas and the molten magnesium is not necessarily required to be the value mentioned above: the quantity of the molten magnesium may, for example, be slightly excessive to cause full reaction of the titanium tetrachloride gas, or the quantity of the titanium tetrachloride gas may be slightly excessive to cause full reaction of the molten magnesium. In addition, the value of Weber number (Wb) in the above-mentioned formula (3) may be altered so as to be kept within the range between $10^3$ and $10^4$ by keeping a constant value of the flow rate of the titanium tetrachloride gas through mixture of an inert gas with the titanium tetrachloride gas.

As the reducing agent, sodium may be employed in place of the above-mentioned magnesium. Sodium has a melting point of 98° C. which is lower than that of magnesium, so that sodium is more easily melted. A lumpy sodium received in the reducing agent container 6 is heated to a temperature within the range of from 100° to 900° C. by means of the heating means 7 provided on the outer periphery of the reducing agent container 6 to become a molten sodium. The molten sodium is atomized in the reaction vessel 4 by means of the titanium tetrachloride gas ejected through the gas nozzle 5 toward the falling flow of the molten sodium falling through the nozzle 8 from the reducing agent container 6 into the reaction vessel 4. A reducing reaction expressed in the above-mentioned formula (2):

$$TiCl_4 + 4Na \rightarrow Ti + 4NaCl \quad (2)$$

takes place between the thus atomized molten sodium and the titanium tetrachloride gas, thereby to produce molten sodium chloride (NaCl) as a molten reaction product 15 and titanium (Ti) particles 14 containing the molten sodium chloride.

The molten sodium chloride 15 and the titanium particles 14 containing the molten sodium chloride having thus produced are treated in the same manner as in the case of the use of magnesium as the reducing agent as described above, to manufacture a titanium powder.

In the reducing reaction between the titanium tetrachloride gas and the molten sodium, when the quantity of the titanium tetrachloride gas ejected through the gas nozzle 5 toward the falling flow of the molten sodium is excessively large relative to the quantity of the molten sodium falling through the nozzle 8 from the reducing agent container 6 into the reaction vessel 4, titanium dichloride ($TiCl_2$) particles are produced in place of the titanium (Ti) particles, resulting in impossibility of the manufacture of a titanium powder. However, when the titanium tetrachloride gas is ejected toward the falling flow of the molten sodium so that the conditions for achieving satisfactory atomizing of the molten sodium as described above are satisfied, the above-mentioned reducing reaction progresses smoothly because there exists the titanium tetrachloride gas in a sufficient quantity around the particles of the atomized molten sodium. A surface tension of the molten sodium at a temperature of the melting point of sodium is smaller than a surface tension of the molten magnesium at a temperature of the melting point of magnesium. In addition, the surface tension is generally reduced at a higher temperature, it is therefore easier to atomize the molten sodium than the molten magnesium.

When the molten magnesium or the molten sodium falling through the nozzle 8 from the reducing agent container 6 into the reaction vessel 4, is satisfactorily atomized by the titanium tetrachloride gas ejected through the gas nozzle 5 in the method of the first embodiment of the present invention, the following effects are available:

(A) The atomized molten magnesium or the atomized molten sodium has a very large surface area as a whole, and is placed in a strong stirring movement. Therefore, the reducing reaction as expressed in the above-mentioned formula (1) or (2) between the atomized molten magnesium or the atomized molten sodium and the titanium tetrachloride gas, progresses very rapidly and smoothly, and the titanium tetrachloride gas is rapidly consumed. As a result, the atomized molten magnesium or the atomized molten sodium never agglomerates into large drops.

(B) The reducing reaction as expressed in the above-mentioned formula (1) or (2) progresses on the particle surfaces of the atomized molten magnesium or the atomized molten sodium. In addition, since the atomized molten magnesium or the atomized molten sodium is placed in a strong stirring movement as described above, the molten magnesium chloride ($MgCl_2$) or the molten sodium chloride (NaCl) produced through the reducing reaction never covers the particles of the atomized molten magnesium or the atomized molten sodium, and hence, never impairs the progress of the reducing reaction. As a result, the reducing reaction smoothly progresses between the atomized molten magnesium or the atomized molten sodium and the titanium tetrachloride gas, thus producing substantially perfect titanium particles 14 and the molten magnesium chloride or the molten sodium chloride as the molten reaction product 15.

The heating temperature of magnesium as the reducing agent in the reducing agent container 6 should be within the range of from 650° to 900° C. With a heating temperature of magnesium of under 650° C., magnesium is not melted. With a heating temperature of magnesium of over 900° C., on the other hand, the temperature in the interior of the reaction vessel 4 excessively increases because the reducing reaction expressed in the above-mentioned formula (1) is an exothermic reaction, and iron forming the reaction vessel 4 reacts with the produced titanium, thus producing Fe-Ti, and resulting in a problem of a lower manufacturing yield of the titanium powder.

The heating temperature of sodium as the reducing agent in the reducing agent container 6 should be within the range of from 100° to 900° C. With a heating temperature of sodium of under 100° C., sodium is not melted. With a heating temperature of sodium of over 900° C., on the other hand, the temperature in the interior of the reaction vessel 4 excessively increases because the reducing reaction expressed in the above-mentioned formula (2) is an exothermic reaction, and iron forming the reaction vessel 4 reacts with the produced titanium, thus producing Fe-Ti, and resulting in a problem of a lower manufacturing yield of the titanium powder.

The temperature of the titanium tetrachloride gas to be ejected toward the falling flow of the molten magnesium or the molten sodium as the molten reducing agent, should be within the range of from 650° to 900° C. With a temperature of the titanium tetrachloride gas of under 650° C., the titanium tetrachloride gas does not expand sufficiently, thus resulting in an insufficient atomizing of the molten magnesium or the molten sodium. When magnesium is used as the reducing agent, furthermore, the temperature of the atomized molten magnesium is reduced to below the melting point thereof by the ejected titanium tetrachloride gas, leading to an inactive reducing reaction. With a temperature of the titanium tetrachloride gas of over 900° C., on the other hand, the temperature in the interior of the raction vessel 4 excessively increases, and iron forming the reaction vessel 4 reacts with the produced titanium, thus producing Fe-Ti, and resulting in a problem of a lower manufacturing yield of the titanium powder.

In the method of the first embodiment of the present invention, as described above, the molten magnesium or the molten sodium as the molten reducing agent falling through the nozzle 8 from the reducing agent container 6 into the reaction vessel 4, is satisfactorily atomized by means of the titanium tetrachloride gas ejected through the gas nozzle 5, and the titanium powder is manufactured through the reducing reaction between the atomized molten magnesium or the atomized molten sodium and the titanium tetrachloride gas. As described above, the atomized molten magnesium or the atomized molten sodium has a very large surface area as a whole, and is placed in a strong stirring movement. The above-mentioned reducing reaction therefore progresses very quickly and smoothly, and the molten magnesium chloride or the molten sodium chloride produced through the reducing reaction never impairs the progress of the reducing reaction.

As described above, the temperature is increased by the heat produced during the above-mentioned reducing reaction, in the portion of the reaction vessel 4 where the titanium tetrachloride gas impinges against the falling flow of the molten magnesium or the molten sodium. However, by setting the diameter of the reaction vessel 4 so that the above-mentioned impingement of the titanium tetrachloride gas against the falling flow of the molten magnesium or the molten sodium takes place at a position not in contact with the side wall 4*a* of the reaction vessel 4, it is possible to prevent the production of Fe-Ti through the reaction of iron forming the reaction vessel 4 with the produced titanium. Since the heat produced during the above-mentioned reducing reaction causes an increase in the temperature in the reaction vessel 4, the preheating temperature of the titanium tetrachloride gas in the preheater 3 can be reduced, and a temperature holding effect of the reaction vessel 4 is also available.

The particle size of the titanium powder to be manufactured may be arbitrarily adjusted by altering the value of Weber number (Wb) in the above-mentioned formula (3). Each particle of the manufactured titanium powder is substantially spherical in shape, and does not have a projection or an acute edge as a particle of the titanium powder manufactured by a conventional pulverizing method. The titanium powder manufactured by the method of the first embodiment of the present invention has therefore a high fluidity and is excellent in press-formability.

Furthermore, by causing the molten magnesium or the molten sodium to continuously fall into the reaction vessel 4, continuously ejecting the titanium tetrachloride gas toward the falling flow of the molten magnesium or the molten sodium to produce the molten reaction product 15 and the titanium particles 14, and continuously discharging same from the reaction vessel 4, it is possible to efficiently and continuously manufacture the titanium powder by means of relatively small-sized equipment.

Now, the second embodiment of the method of the present invention is described with reference to FIG. 1. In the second embodiment of the method of the present invention, a titanium composite powder for a titanium alloy article which comprises titanium and at least one metal to be alloyed with titanium such as aluminum, tin and zinc, is manufactured as follows.

A reducing agent such as magnesium, and at least one metal, such as aluminum, selected from the group consisting of aluminum, tin and zinc are received in the reducing agent container 6 as shown in FIG. 1, and are melted by means of the heating mechanism 7 to prepare a molten magnesium alloy at a temperature within the range of from 650° to 900° C. as a molten reducing agent. Then, the thus prepared molten magnesium alloy is caused to fall through the nozzle 8 into the reaction vessel 4.

Then, a titanium tetrachloride gas at a temperature within the range of from 650° to 900° C. is ejected through the gas nozzle 5 toward the falling flow of the molten magnesium alloy falling through the nozzle 8 from the reducing agent container 6 into the reaction vessel 4 to atomize the molten magnesium alloy. A reducing reaction expressed in the above-mentioned formula (1) takes place between magnesium in the thus atomized molten magnesium alloy and the titanium tetrachloride gas, thereby to produce molten magnesium chloride ($MgCl_2$) as the molten reaction product 15 and titanium composite particles 14 comprising titanium (Ti) particles containing the molten magnesium chloride and aluminum (Al) particles. In the thus produced titanium composite particles 14, the titanium particles are physically combined with the aluminum particles.

The titanium composite particles 14 containing the molten magnesium chloride having thus produced are discharged outside the reaction vessel 4 from the titanium particles discharge port 13 provided in the bottom wall 4*b* of the vessel 4, as described above concerning the manufacture of the titanium powder according to the first embodiment of the method of the present invention. Then, from the thus discharged titanium composite particles 14 containing the magnesium chloride, the magnesium chloride is removed by a known method such as a water leaching or a vacuum evaporation, whereby a titanium composite powder comprising a titanium powder and an aluminum powder is manufactured.

In place of the molten magnesium alloy at a temperature within the range of from 650° to 900° C., a molten sodium alloy at a temperature within the range of from 100° to 900° C. comprising sodium and aluminum may be used as the reducing agent. When using the molten sodium alloy, the molten sodium alloy is atomized by means of the titanium tetrachloride gas at a temperature within the range of from 650° to 900° C. A reducing reaction expressed in the above-mentioned formula (2) takes place between sodium in the thus atomized molten sodium alloy and the titanium tetrachloride gas, thereby to produce molten sodium chloride (NaCl) as the molten reaction product 15 and titanium composite particles 14 comprising titanium (Ti) particles containing the molten sodium chloride and aluminum (Al) particles. In the thus produced titanium composite particles 14, the titanium particles are physically combined with the aluminum particles.

The sodium chloride is removed from the thus produced titanium composite particles 14 containing the sodium chloride by a known method such as a water leaching or a vacuum evaporation, whereby a titanium composite powder comprising a titanium powder and an aluminum powder is manufactured.

In the manufacture of the titanium composite powder according to the second embodiment of the method of the present invention, when the content of magnesium in the molten magnesium alloy or the content of sodium in the molten sodium alloy is small, the at least one metal in the above-mentioned molten alloy reacts with the titanium tetrachloride gas to produce a chloride of the at least one metal. The content of magnesium in the molten magnesium alloy or the content of sodium in the molten sodium alloy should therefore preferably be excessive relative to the titanium tetrachloride gas.

Furthermore, by adjusting the content ratio of magnesium in the molten magnesium alloy or of sodium in the molten sodium alloy to the at least one metal, it is possible to adjust the content of the at least one metal powder in the titanium composite powder.

For the same reason as that described for the manufacture of the titanium powder according to the first embodiment of the method of the present invention, when a value of Weber number (Wb) as expressed in the above-mentioned formula (3) is kept within the range between $10^3$ and $10^4$, the molten magnesium alloy or the molten sodium alloy falling through the nozzle 8 from the reducing agent container 6 into the reaction vessel 4, is satisfactorily atomized by means of the titanium tetrachloride gas ejected through the gas nozzle 5 toward the falling flow of the molten magnesium alloy or the molten sodium alloy. In addition, for the same reason as that described for the manufacture of the titanium powder according to the first embodiment of the method of the present invention, the temperature of the molten magnesium alloy should be within the range of from 650° to 900° C.; the temperature of the molten sodium alloy should be within the range of from 100° to 900° C.; and the temperature of the titanium tetrachloride gas should be within the range of from 650° to 900° C.

As the above-mentioned at least one metal, tin and/or zinc may be employed in place of aluminum.

Now, the third embodiment of the method of the present invention is described with reference to FIG. 1. In the third embodiment of the method of the present invention, a titanium composite powder for a titanium alloy article which comprises titanium and at least one metal to be alloyed with titanium such as aluminum, vanadium, tin, chromium, iron, zirconium and zinc, is manufactured as follows.

A reducing agent, for example, magnesium is received in the reducing agent container 6 as shown in FIG. 1, and is melted by means of the heating means 7 to prepare a molten magnesium at a temperature within the range of from 650° to 900° C. as a molten reducing agent. Then, the thus prepared molten magnesium is caused to fall through the nozzle 8 into the reaction vessel 4.

Then, a liquid titanium tetrachloride is received in the $TiCl_4$ container 1, and a liquid chloride of at least one metal selected from the group consisting of aluminum, vanadium, tin, chromium, iron, zirconium and zinc, for example, a liquid vanadium chloride is received in a container 16 for chloride other than $TiCl_4$. The liquid titanium tetrachloride and the liquid vanadium chloride are mixed together before being introduced into the carbureter 2, in which the resultant mixture is vaporized to prepare a mixed gas comprising a titanium tetrachloride gas and a vanadium chloride gas.

Then, the thus prepared mixed gas at a temperature within the range of from 650° to 900° C. is ejected through the gas nozzle 5 toward the falling flow of the molten magnesium falling through the nozzle 8 from the reducing agent container 6 into the reaction vessel 4 to atomize the molten magnesium. A reducing reaction expressed in the above-mentioned formula (1) takes place between the thus atomized molten magnesium and the mixed gas comprising the titanium tetrachloride gas and the vanadium chloride gas, thereby to produce molten magnesium chloride ($MgCl_2$) as the molten reaction product 15 and titanium composite particles 14 comprising titanium (Ti) particles containing the molten magnesium chloride and vanadium (V) particles. In the thus produced titanium composite particles 14, the titanium particles are physically combined with the vanadium particles.

The titanium composite particles 14 containing the molten magnesium chloride having thus produced are discharged outside the reaction vessel 4 from the titanium particles discharge port 13 provided in the bottom wall **4*b* of the reaction vessel 4, as described concerning the manufacture of the titanium powder according to the first embodiment of the method of the present invention. Then, from the thus discharged titanium composite particles 14** containing the magnesium chloride, the magnesium chloride is removed by a known method such as a water leaching or a vacuum evaporation, whereby a titanium composite powder comprising a titanium powder and a vanadium powder is manufactured.

A molten sodium at a temperature within the range of from 100° to 900° C. may be used as the reducing agent in place of the molten magnesium at a temperature within the range of from 650° to 900° C. When using the molten sodium alloy, the molten sodium is atomized by means of the mixed gas at a temperature within the range of from 650° to 900° C. comprising the titanium tetrachloride gas and the vanadium chloride gas. A reducing reaction expressed in the above-mentioned formula (2) takes place between the thus atomized molten sodium and the titanium tetrachloride gas in the mixed gas, thereby to produce molten sodium chloride (NaCl) as the molten reaction product 15 and titanium composite particles 14 comprising titanium (Ti) particles containing the molten sodium chloride and vanadium (V) particles. In the thus produced titanium composite particles 14, the titanium particles are physically combined with the vanadium particles.

From the thus produced titanium composite particles 14 containing the sodium chloride, the sodium chloride is removed by a known method such as a water leaching or a vacuum evaporation, whereby a titanium composite powder comprising a titanium powder and a vanadium powder.

As the above-mentioned at least one metal, aluminum, tin, chromium, iron, zirconium and/or zinc may be employed in place of vanadium.

For the same reason as that described for the manufacture of the titanium powder according to the first embodiment of the method of the present invention, when a value of Weber number (Wb) as expressed in the above-mentioned formula (3) is kept within the range between $10^3$ and $10^4$, the molten magnesium or the molten sodium falling through the nozzle 8 from the reducing agent container 6 into the reaction vessel 4, is satisfactorily atomized by means of the mixed gas ejected through the gas nozzle 5 toward the falling flow of the molten magnesium or the molten sodium. In addition, for the same reason as that described for the manufacture of the titanium powder according to the first embodiment of the method of the present invention, the temperature of the molten magnesium should be within the range of from 650° to 900° C.; the temperature of the molten sodium should be within the range of from 100° to 900° C.; and the temperature of the mixed gas should be within the range of from 650° to 900° C.

In the manufacture of the titanium composite powder according to the second and third embodiments of the method of the present invention, the molten magnesium alloy, the molten sodium alloy, and the mixed gas comprising the titanium tetrachloride gas and the chloride gas of the at least one metal have in all cases uniform chemical compositions. It is therefore possible to manufacture a titanium composite powder having a uniform chemical composition without carrying out a difficult operation of uniformly mixing a titanium powder and a metal powder to be alloyed with the titanium powder as in any of the conventional methods for manufacturing a titanium alloy, thus permitting improvement of the quality and the manufacturing yield of a titanium alloy article.

In the method of the present invention, furthermore, a titanium compound powder is manufactured by the following method.

The titanium particles during production or immediately after production in the reaction vessel 4 are very active. Therefore, by blowing a nitrogen gas into the reaction vessel 4 through the inert gas blowing port 10 provided in the upper portion of the side wall 4*a* of the reaction vessel 4 to keep a nitrogen atmosphere in the interior of the reaction vessel 4, the titanium particles produced in the reaction vessel 4 immediately react with nitrogen to become titanium nitride (TiN) particles. Then a titanium nitride powder is manufactured from the titanium nitride (TiN) particles in the same manner as described above concerning the manufacture of the titanium powder according to the first embodiment of the method of the present invention.

Now, the method of the present invention is described further in detail by means of examples.

EXAMPLE 1

A titanium powder was manufactured in accordance with the first embodiment of the method of the present invention by the use of the apparatus shown in FIG. 1. As the reaction vessel 4, a cylindrical vessel having an inside diameter of 20 cm and a height of 80 cm was used. As the reducing agent container 6 arranged on the top end of the reaction vessel 4, a cylindrical vessel having an inside diameter of 6 cm and a height of 55 cm. The nozzle 8 provided in the bottom wall of the reducing agent container 6 had a bore diameter of 1.5 mm and was inserted into the upper portion of the reaction vessel 4 through an upper opening having an inside diameter of 8 cm provided on the top end of the reaction vessel 4. The carbureter 2 and the preheater 3 were made from a silica tube having an inside diameter of 2.5 cm and a length of 40 cm. As the gas nozzle 5 in the reaction vessel 4, four lance type nozzles, each having a bore diameter of 1 mm, were used. The four lance type nozzles were arranged around the nozzle 8 so that gases ejected from the four lance type nozzles were concentrated at a position 2.5 cm below from the lower end of the nozzle 8.

A lumpy magnesium in an amount of 392 g was charged into the reducing agent container 6, and was heated to a temperature of about 700° C. by means of the heating means 7 while keeping an argon gas atmosphere in the reducing agent container 6, to convert the lumpy magnesium into a molten magnesium. While the lumpy magnesium was converted into the molten magnesium, the nozzle 8 of the reducing agent container 6 was clogged off by a stopper.

A liquid titanium tetrachloride at a room temperature in an amount of 500 g was charged, on the other hand, into the $TiCl_4$ container 1. The liquid titanium tetrachloride was introduced into the carbureter 2 while adjusting the flow rate thereof by means of a regulating valve and a flow meter not shown, and the liquid titanium tetrachloride was heated in the carbureter 2 into a titanium tetrachloride gas at a temperature of about 300° C. The titanium tetrachloride gas was then introduced into the preheater 3, in which the titanium tetrachloride gas was heated to a temperature of about 800° C.

The upper portion of the reaction vessel 4 was kept at a temperature of about 600° C. by means of the heating means 9, and the lower portion thereof was kept at a room temperature. By opening the stopper of the nozzle 8 provided in the bottom wall of the reducing agent container 6, the molten magnesium in the reducing agent container 6 was caused to fall through the nozzle 8 into the reaction vessel 4. The titanium tetrachloride gas heated to a temperature of about 800° C. was ejected at a flow velocity of about 101 m/second through the gas nozzle 5 toward the falling flow of the molten magnesium thus falling into the reaction vessel 4 to atomize the molten magnesium. The atomizing was carried out for about six minutes. In this atomizing, the molten magnesium in the amount of 392 g in the reducing agent container 6 was totally consumed, and 296 g of the molten titanium tetrachloride in the amount of 500 g in the $TiCl_4$ container 1 were consumed. The temperature of the portion of the reaction vessel 4, in which the titanium tetrachloride gas was ejected toward the falling flow of the molten magnesium, increased to a temperature at which the color of that portion changed into orange. A stainless steel vat not shown was placed on the bottom of the reaction vessel 4 to collect a reaction product therein.

As a result, the reaction product in an amount of 493 g was accumulated in the vat, and the reaction product in an amount of 117 g was deposited onto the inner surface of the side wall 4*a* of the reaction vessel 4. The reaction product in the amount of 493 g in the vat comprised a non-reacted magnesium in an amount of 336 g and a mixture in an amount of 157 g comprising titanium particles and a magnesium chloride. Most of the reaction product in the amount of 117 g deposited onto the inner surface of the side wall 4*a* of the reaction vessel 4 was also a mixture comprising titanium particles and a magnesium chloride. The non-reacted magnesium was present in the vat because ejection of the titanium tetrachloride gas through the gas nozzle 5 was late for the start of fall of the molten magnesium.

From the mixtures in an amount of 274 g in total comprising the titanium particles and the magnesium chloride, which were recovered from the vat in the reaction vessel 4 and from the inner surface of the side wall 4*b* of the reaction vessel 4, the magnesium chloride was removed by means of a water leaching. Whereby a titanium powder in an amount of 55 g was manufactured. Since the theoretical amount of production of titanium relative to the consumed molten titanium tetrachloride in an amount of 296 g is 73 g, the above-mentioned titanium powder was recovered with a yield of about 75%. The thus manufactured titanium powder was in black-grey (grey in microscopic observation). Application of the X-ray diffraction revealed that the titanium powder was metallic titanium. The titanium powder had a particle size of from 100 to 200 μm, and comprised an aggregate in which spherical particles having a particle size of from 1 to 2 μm were gathered into a cluster. The above-mentioned titanium powder having a particle size of from 100 to 200 μm could easily be pulverized into a titanium powder having a particle size of up to 10 μm by subjecting same to a vibration mill for about 30 seconds.

EXAMPLE 2

A titanium composite powder was manufactured in accordance with the second embodiment of the method of the present invention by the use of the apparatus shown in FIG. 1. In the reducing agent container 6, a lumpy magnesium in an amount of 349.2 g and a lumpy aluminum in an amount of 38.8 g were melted to prepare a molten Mg-Al alloy in an amount of 388 g at a temperature of about 700° C. Then, the molten Mg-Al alloy at a temperature of about 700° C. in the reducing agent container 6 was caused to fall through the nozzle 8 into the reaction vessel 4 in the same manner as in the Example 1. A titanium tetrachloride gas at a temperature of about 800° C. was ejected at a flow velocity of about 101 m/second through the gas nozzle 5 toward the falling flow of the molten Mg-Al alloy thus falling into the reaction vessel 4 to atomize the molten Mg-Al alloy. The atomizing was carried out for about five minutes. In this atomizing, the molten Mg-Al alloy in the amount of 388 g in the reducing agent container 6 was totally consumed, and 325 g of the molten titanium tetrachloride in the $TiCl_4$ container 1 were consumed.

As in the Example 1, a stainless steel vat not shown was placed on the bottom of the reaction vessel 4 to collect a reaction product therein.

As a result, the reaction product in an amount of 682 g in total, which comprised a non-reacted magnesium and a mixture comprising titanium composite particles and a magnesium chloride, was obtained in the reaction vessel 4. This reaction product was subjected to the same treatment as in the Example 1 to manufacture a titanium composite powder in an amount of 67 g in total comprising a titanium powder and an aluminum powder from the reaction product in a total amount of 682 g. A chemical analysis of this titanium composite powder revealed that titanium and aluminum in the titanium composite powder were in a ratio of 25:1 in weight.

EXAMPLE 3

A titanium composite powder was manufactured in accordance with the third embodiment of the method of the present invention by the use of the apparatus shown in FIG. 1. As in the Example 1, a lumpy magnesium in an amount of 392 g was charged into the reducing agent container 6, and was heated to a temperature of about 700° C. by means of the heating means 7 while keeping an argon gas atmosphere in the reducing agent container 6, to convert the lumpy magnesium into a molten magnesium.

As in the Example 1, on the other hand, a liquid titanium tetrachloride at a room temperature in an amount of 500 g was charged into the $TiCl_4$ container 1. Then, a liquid vanadium chloride ($VCl_4$) having a boiling point of 148° C. was charged into the container 16 for a chloride other than $TiCl_4$. The liquid titanium tetrachloride was directed toward the carbureter 2 while adjusting the flow rate thereof by means of a regulating valve and a flow meter not shown, and before being introduced into the carbureter 2, the liquid vanadium chloride ($VCl_4$) was mixed at a flow rate of about 0.7 $cm^3$ per minute with the liquid titanium tetrachloride. The resultant mixed liquid was then introduced into the carbureter 2, in which the mixed liquid was heated and vaporized to prepare a mixed gas at a temperature of about 300° C. comprising a titanium tetrachloride gas and a vanadium chloride gas. The thus prepared mixed gas was introduced into the preheater 3, in which the mixed gas was heated to a temperature of about 800° C.

Then, in the same manner as in the Example 1, the molten magnesium at a temperature of about 700° C. in the reducing agent container 6 was caused to fall through the nozzle 8 into the reaction vessel 4. The mixed gas at a temperature of about 800° C. comprising the titanium tetrachloride gas and the vanadium chloride gas was ejected at a flow velocity of about 101 m/second through the gas nozzle 5 toward the falling flow of the molten magnesium thus falling into the reaction vessel 4 to atomize the molten magnesium. The atomizing was carried out for about five minutes. In this atomizing, the molten magnesium in the amount of 392 g in the reducing agent container 6 was totally consumed, and 348 g of the molten titanium tetrachloride in an amount of 500 g in the $TiCl_4$ container 1 were consumed.

As in the Example 1, a stainless steel vat not shown was placed on the bottom of the reaction vessel 4 to collect a reaction product therein.

As a result, the reaction product in an amount of 662 g in total, which comprised a non-reacted magnesium and a mixture comprising titanium composite particles and a magnesium chloride, was obtained in the reaction vessel 4. This reaction product was subjected to the same treatment as in the Example 1 to manufacture a titanium composite powder in an amount of 68 g in total comprising a titanium powder and a vanadium powder from the reaction product in a total amount of 662 g. A chemical analysis of this titanium composite powder revealed that titanium and vanadium in the titanium composite powder were in a ratio of 100:1.6 in weight.

According to the method of the present invention, as described above in detail, it is possible to continuously manufacture at a high productivity through simple steps a titanium powder as a material for the manufacture of titanium articles and a titanium composite powder as a material for the manufacture of titanium alloy articles by a powder metallurgy process, thus providing industrially useful effects.

What is claimed is:

1. A method for manufacturing titanium powder comprising:

introducing a vertically downwardly flowing stream of a molten reducing agent at a temperature from 100° to 900° C. into a reaction vessel through a nozzle;

ejecting a stream of titanium tetrachloride gas at a temperature from 650° to 900° C. to contact the stream of said molten reducing agent and atomize said molten reducing agent and react said atomized molten reducing agent with said titanium tetrachloride gas at a reaction temperature of up to 1000° C. to form titanium particles and a chloride reaction product, wherein said flow stream of titanium tetrachloride gas has a flow velocity u in cm/sec determined by following equation:

$$10^3 \leqq \frac{D_L \cdot u^2 \cdot \rho}{\tau} \leqq 10^4$$

where, $D_L$ is an inner diameter of cm of said nozzle, $\rho$ is a difference in density in g/cm$^3$ between said molten reducing agent and said titanium tetrachloride gas, and $\tau$ is a surface tension in dyne/cm between said molten reducing agent and said titanium tetrachloride gas, and separating said titanium particles from said chloride reaction product outside of said vessel to produce a titanium powder.

2. The method as claimed in claim 1, wherein said molten reducing agent comprises molten magnesium at a temperature of from 650° to 900° C.; and said molten reaction product comprises molten magnesium chloride.

3. The method as claimed in claim 1, wherein said molten reducing agent comprises molten sodium at a temperature of from 100° to 900° C.; and said molten reaction product comprises molten sodium chloride.

4. A method for manufacturing titanium composite powder comprising:

introducing a vertically downwardly flowing stream of a molten reducing agent comprising a molten alloy at a temperature from 100° to 900° C. into a reaction vessel through a nozzle;

ejecting a stream of a titanium tetrachloride gas at a temperature of from 650° to 900° C. to contact the stream of said molten reducing agent and atomize said molten reducing agent and react said atomized molten reducing agent with said titanium tetrachloride gas at a reaction temperature of up to 1000° C. to form titanium composite particles and a chloride reaction product, wherein said flow stream of titanium tetrachloride gas has a flow velocity u in cm/sec determined by following equation:

$$10^3 \leqq \frac{D_L \cdot u^2 \cdot \rho}{\tau} \leqq 10^4$$

where, $D_L$ is an inner diameter in cm of said nozzle, $\rho$ is a difference in density in g/cm$^3$ between said molten reducing agent and said titanium tetrachloride gas, $\tau$ is a surface tension in dyne/cm between said molten reducing agent and said titanium tetrachloride gas, and separating said titanium composite particles from said chloride reaction product outside of said vessel to produce a titanium composite powder.

5. The method as claimed in claim 4, wherein said molten alloy forming said molten reducing agent comprises magnesium and at least one metal selected from the group consisting of aluminum, tin and zinc; said molten reducing agent is at a temperature of from 650° to 900° C.; said reaction product comprises magnesium chloride; and said titanium composite particles comprise titanium particles and particles of said at least one metal.

6. The method as claimed in claim 4, wherein said molten alloy forming said molten reducing agent comprises sodium and at least one metal selected from the group consisting of aluminum, tin and zinc; said molten reducing agent is at a temperature from 100° to 900° C.; said reaction product comprises sodium chloride; and said titanium composite particles comprise titanium particles and particles of said at least one metal.

7. A method for manufacturing titanium composite powder, comprising:

introducing a vertically downwardly flowing stream of a molten reducing agent at a temperature of from 100° to 900° C. into a reaction vessel through a nozzle;

ejecting a stream of a mixed gas at a temperature from 650° to 900° C. to contact the stream of said molten reducing agent, said mixed gas comprising gaseous titanium tetrachloride and a gaseous chloride of at least one metal selected from the group consisting of aluminum, vanadium, tin, chromium, iron, zirconium and zinc, said contact causing said molten reducing agent to atomize and to react with said mixed gas at a reaction temperature of up to 1000° C. to form titanium composite particles and a chloride reaction product, wherein said flow stream of mixed gas has a flow velocity u in cm/sec determined by following equation:

$$10^3 \leqq \frac{D_L \cdot u^2 \cdot \rho}{\tau} \leqq 10^4$$

where, $D_L$ is an inner diameter of said nozzle, $\rho$ is a difference in density in g/cm$_3$ between said molten reducing agent and said mixed gas, $\tau$ is a surface tension in dyne/cm between said molten reducing agent and said mixed gas, and separating said titanium composite particles from said chloride reaction product outside of said vessel to produce a titanium composite powder.

8. The method as claimed in claim 7, wherein said molten reducing agent comprises molten magnesium at a temperature within a range of from 650° to 900° C.; said reaction product comprises magnesium chloride; and said titanium composite particles comprise titanium particles and particles of said at least one metal.

9. The method as claimed in claim 7, wherein said molten reducing agent comprises molten sodium at a temperature of from 100° to 900° C.; said reaction product comprises sodium chloride; and said titanium composite particles comprise titanium particles and particles of said at least one metal.

10. The method as claimed in claim 1, which further comprises heating liquid titanium tetrachloride in a carburetor to a temperature of 150° to 300° C. to form a titanium tetrachloride gas and preheating said titanium tetrachloride gas to a temperature of 650° to 900° C. prior to ejecting the titanium tetrachloride gas.

11. The method as claimed in claim 1, which further comprises blowing an inert gas into the reaction vessel.

12. The method as claimed in claim 11, wherein the inert gas is argon.

13. The method as claimed in claim 4, wherein the molten reducing agent comprises molten magnesium or molten sodium and the amount of the molten magnesium or molten sodium is in excess relative to the stoichiometric amount of the titanium tetrachloride gas.

14. The method as claimed in claim 4, wherein the molten reducing agent comprises molten magnesium and molten aluminum.

15. The method as claimed in claim 7, wherein the mixed gas comprises titanium tetrachloride and vanadium chloride.

16. The method as claimed in claim 1, which further comprises blowing nitrogen into said reaction vessel to maintain a nitrogen atmosphere in said reaction vessel whereby to form titanium nitride particles.

17. The method as claimed in claim 1, wherein the density of the molten reducing agent, the density of the titanium tetrachloride gas and the surface tension between the molten reducing agent and the titanium tetrachloride gas are determined at a temperature of the melting point of the reducing agent.

18. The method as claimed in claim 17, wherein the reducing agent is magnesium and the amount of titanium tetrachloride gas to the amount of magnesium is in a molar ratio of 1:2.

19. The method as claimed in claim 18, wherein the ejecting of the titanium tetrachloride in contact with said reducing agent occurs at a position in the reaction vessel not in contact with a side wall of the reaction vessel.

20. The method as claimed in claim 19, wherein said titanium tetrachloride gas is ejected in a downwardly inclined direction to contact the flow of said molten reducing agent.

21. The method as claimed in claim 1, wherein the atomized reducing agent is strongly stirred.

22. The method as claimed in claim 4, wherein the atomized reducing agent is strongly stirred.

23. The method as claimed in claim 7, wherein the atomized reducing agent is strongly stirred.

* * * * *